US006585173B2

(12) United States Patent
Schmon et al.

(10) Patent No.: US 6,585,173 B2
(45) Date of Patent: Jul. 1, 2003

(54) PAINT SPRAY GUN

(75) Inventors: Ewald Schmon, Grafenberg (DE); Peter Dettlaff, Remseck (DE)

(73) Assignee: Sata-Farbspritztechnik GmbH & Co., Kornwestheim (DE)

( * ) Notice: Subject to any disclaimer, the term of this patent is extended or adjusted under 35 U.S.C. 154(b) by 0 days.

(21) Appl. No.: 10/193,727

(22) Filed: Jul. 11, 2002

(65) Prior Publication Data

US 2003/0025000 A1 Feb. 6, 2003

(30) Foreign Application Priority Data

Jul. 19, 2001 (DE) ..... 101 35 104

(51) Int. Cl.[7] ..... B05B 7/02; B67D 5/08

(52) U.S. Cl. ..... 239/526; 239/71; 239/296; 239/415; 239/528; 239/DIG. 14; 239/290; 239/527; 73/714; 73/753; 73/756

(58) Field of Search ..... 239/71, 74, 290, 239/296, 398, 413, 414, 415, 417.5, 526, 528, 527, DIG. 14; 73/714, 753, 756

(56) References Cited

U.S. PATENT DOCUMENTS 4,585,168 A * 4/1986 Even et al. ..... 239/527
5,191,797 A * 3/1993 Smith ..... 73/714
5,613,637 A * 3/1997 Schmon ..... 239/296
RE35,769 E * 4/1998 Grime et al. ..... 239/71

* cited by examiner

*Primary Examiner*—Steven J. Ganey

(57) ABSTRACT

The invention relates to a paint spray gun with a paint nozzle placed on a gun body, an air nozzle placed around the paint nozzle, a compressed air valve placed within a piston borehole in the gun body, a compressed air borehole running through a handgrip of the gun body to the piston borehole, and a pressure-sensing and pressure display device placed in the hand grip. For sensing and displaying the spray pressure, a tube is placed in the compressed air borehole at a distance from its inner wall. The tube forms, in the interior, a channel for the compressed air supply to a part of the piston borehole placed upstream of the compressed-air valve, and borders an intermediate space between its exterior and the inner wall of the compressed air borehole. The intermediate space is connected via a first connecting channel with a pressure chamber placed downstream of the compressed-air valve and via a second connecting channel with a pressure gauge chamber in the handgrip allocated to the pressure-sensing and pressure display device.

9 Claims, 2 Drawing Sheets

PAINT SPRAY GUN

FIELD OF THE INVENTION

The invention relates to a paint spray gun.

BACKGROUND OF THE INVENTION

To achieve optimal results with paint spray guns, it is extremely important to set the spray pressure so as to obtain optimal atomization at a good operating speed and high application efficiency. For a precise setting of the pressure or monitoring of the input pressure, a pressure regulating valve with a pressure gauge is often added at the air inlet. However, the operation of the spray gun is impeded by the pressure regulating valve and pressure gauge, which are usually attached to the underside of the gun handgrip.

The Sata company therefore developed a spray gun, for example, marketed under the name of "Sata jet RP, Digital," in which the pressure-sensing and pressure display device is built into the grip of the gun body. In this known spray gun, a connecting borehole is provided at the bottom end of the handgrip, from the compressed air supply borehole running through the pistol grip to a pressure gauge chamber placed in the handgrip. Through such an arrangement, however, only the gun air inlet pressure can be monitored, not the spray pressure adjustable through a valve system.

SUMMARY OF THE INVENTION

An object of the invention, therefore, is to create a spray gun that facilitates the sensing and display of the spray pressure using simple means.

The invention relates to a paint spray gun with a paint nozzle placed on a gun body, an air nozzle placed around the paint nozzle, a compressed air valve placed within a piston borehole in the gun body, a compressed air borehole running through a handgrip of the gun body to the piston borehole, and a pressure-sensing and pressure display device placed in the hand grip. For sensing and displaying the spray pressure, a tube is placed in the compressed air borehole at a distance from its inner wall. The tube forms, in the interior, a channel for the compressed air supply to a part of the piston borehole placed upstream of the compressed-air valve, and borders an intermediate space between its exterior and the inner wall of the compressed air borehole. The intermediate space is connected via a first connecting channel with a pressure chamber placed downstream of the compressed-air valve and via a second connecting channel with a pressure gauge chamber in the handgrip allocated to the pressure-sensing and pressure display device.

In the spray gun according to the invention, the compressed air can be conducted through the tube inserted into the compressed air borehole to the valve system that can be actuated by a trigger, while the intermediate space formed between the inner wall of the compressed air borehole and the outer wall of the tube can be used for a compressed air connection between a pressure chamber placed downstream of the valve system and a pressure-sensing and pressure display device integrated into the handgrip of the gun body. Through the intermediate space and easily manufacturable connecting boreholes, the spray pressure that can be adjusted through the valve system can also be displayed without connection channels that are expensive to manufacture.

The use of a digital display device that is normally activated only when a predetermined pressure threshold is exceeded has the advantage, through the design according to the invention, of longer battery life for supplying power to the display device, since pressure is displayed only when the trigger is actuated.

Other embodiments may include additional features. Thus, for example, the connection between the pressure chamber downstream of the valve system and the intermediate space can be produced in a technically simple manner through a first connecting borehole, shifted to the side of the mid-axis of the compressed air borehole, and which runs diagonally through outside the handgrip to the pressure chamber, and is connected in a middle region with the intermediate space. At its outer end, the first connection borehole is sealed through a ball or another suitable sealing element.

The connection from the intermediate space to the pressure gauge chamber placed in the gun grip may also be accomplished through a second connecting borehole that runs expediently from the inlet of the compressed air borehole diagonally through the handgrip to the pressure gauge chamber. In this way, the second connecting borehole need not be sealed by a ball or the like, as is necessary with the first connecting borehole. The first and/or the second connecting borehole are, in a further advantageous embodiment, designed at least partially as capillary boreholes. Through such a capillary, solvents used for cleaning the spray gun, or even lacquer or paint residue can be prevented from reaching the area of the pressure sensor and consequently impairing or hindering the proper gauging of the pressure.

BRIEF DESCRIPTION OF THE DRAWINGS

Further particularities and advantages of the invention are revealed in the following description of a preferred embodiment using the drawing. Shown are.

DETAILED DESCRIPTION OF THE INVENTION

Figure 1:
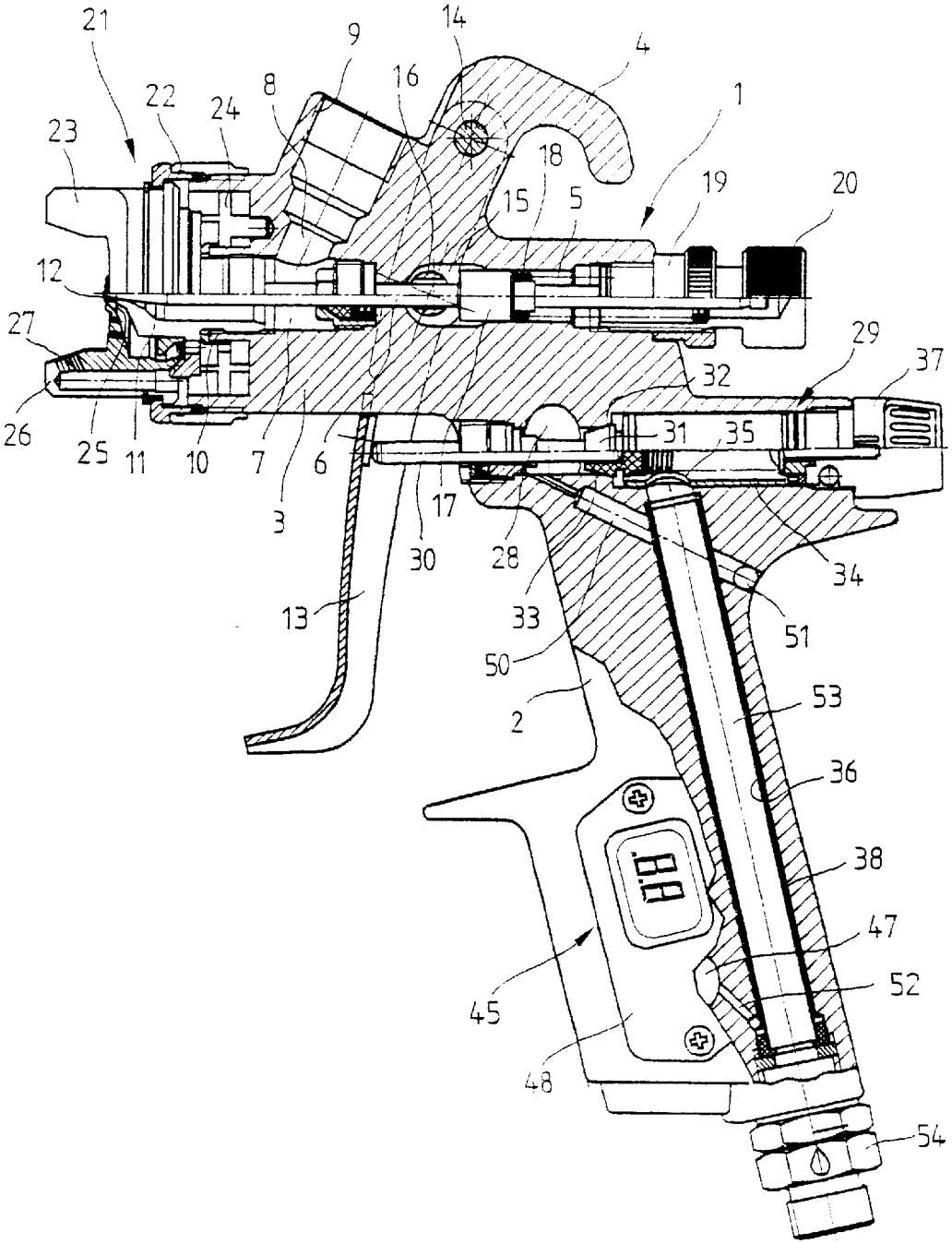
FIG. 1 is a partial cross section of a view of a paint spray gun according to the invention.

The paint spray gun shown in FIG. 1 has a gun body 1 with a handgrip 2 and an upper part 3, on which a suspension hook 4 is shaped. Running through the upper part 3 is a multi-graduated through hole 5 that goes all the way from front to back, in which a nozzle needle 6 is led in an axially adjustable manner. The through hole 5 exhibits a front region 7 with an expanded diameter, into which a diagonal inlet borehole 8 with an internal screw thread 9 for screwing on a paint reservoir, not shown, leads.

Provided on the front end of the through hole 5 is an internal screw thread 10, through which a paint nozzle 11 is screwed into the upper part 3 of the gun body 1. The paint nozzle 11 includes on its front end a nozzle borehole 12, which together with a tapering front end-part of the nozzle needle 6, axially movable through a trigger 13, constitutes an adjustable inlet for the paint, the lacquer, or the like. To adjust the nozzle needle, the trigger 13, coupled to the gun body 1 through a pin 14, includes a crosspin 16 through which the nozzle needle 6 runs, and which is arranged within a recess 15 in the gun body 1. On the nozzle needle 6, a needle sleeve 17 is fixed, whose front end the crosspin 16 of the trigger 13 reaches upon pulling back towards the apparatus. Lying against the rear end of the needle sleeve 17 is the front end of a compression spring 18, which supports itself with its rear end on a paint quantity adjusting screw 20 secured by a lock nut 19. By pulling back the trigger 13, the nozzle needle 6 is moved to the back against the force of the compression spring so that the nozzle borehole 12 opens to release the paint.

An air nozzle 21 with an air cap 23 that can be fastened through a swivel nut 22 on the upper part 3 of the gun body 1 and an air distribution ring 24 are placed around the paint nozzle 11. A ring slot 25 surrounding the nozzle borehole 12 of the paint nozzle 11 is bordered by the air cap 23. Moreover, so-called horn air boreholes 27 for jet formation are placed in forward-protruding horns 26 of the air cap 23. The compressed air supply to the air nozzle 21 takes place through compressed air boreholes at the side, not discernible in the sectional illustrations of FIGS. 1 and 2, which are connected with a pressure chamber 28 of a valve system 29 for controlling the compressed air supply to the air nozzle 21.

The valve system 29 includes a valve piston 31 that can be actuated through the trigger 13 by means of a rod 30, the valve piston together with a valve face 32 in a piston borehole 33 placed in the gun body 1 forming a compressed air valve between a part of the piston borehole 33 placed upstream of the valve face 32, and the pressure chamber 28 connected to the air nozzle 21 downstream of the valve face 32. In the part of the piston borehole 33 lying upstream of the valve face 32, furthermore, a rotatable sleeve 34 is placed, exhibiting a cross hole 35 in the region of the opening of a compressed air borehole 36 running through the handgrip 2 into the part of the piston borehole 33 upstream of the valve face 32. The sleeve 34 is connected in a rotationally fixed manner with a control element 37, which is placed in a rotatable manner at the rear end of the piston borehole 33. By turning the control element 37, the sleeve 34 can be turned and the air passage in the region of the cross hole 35 can consequently be adjusted.

Figure 2:
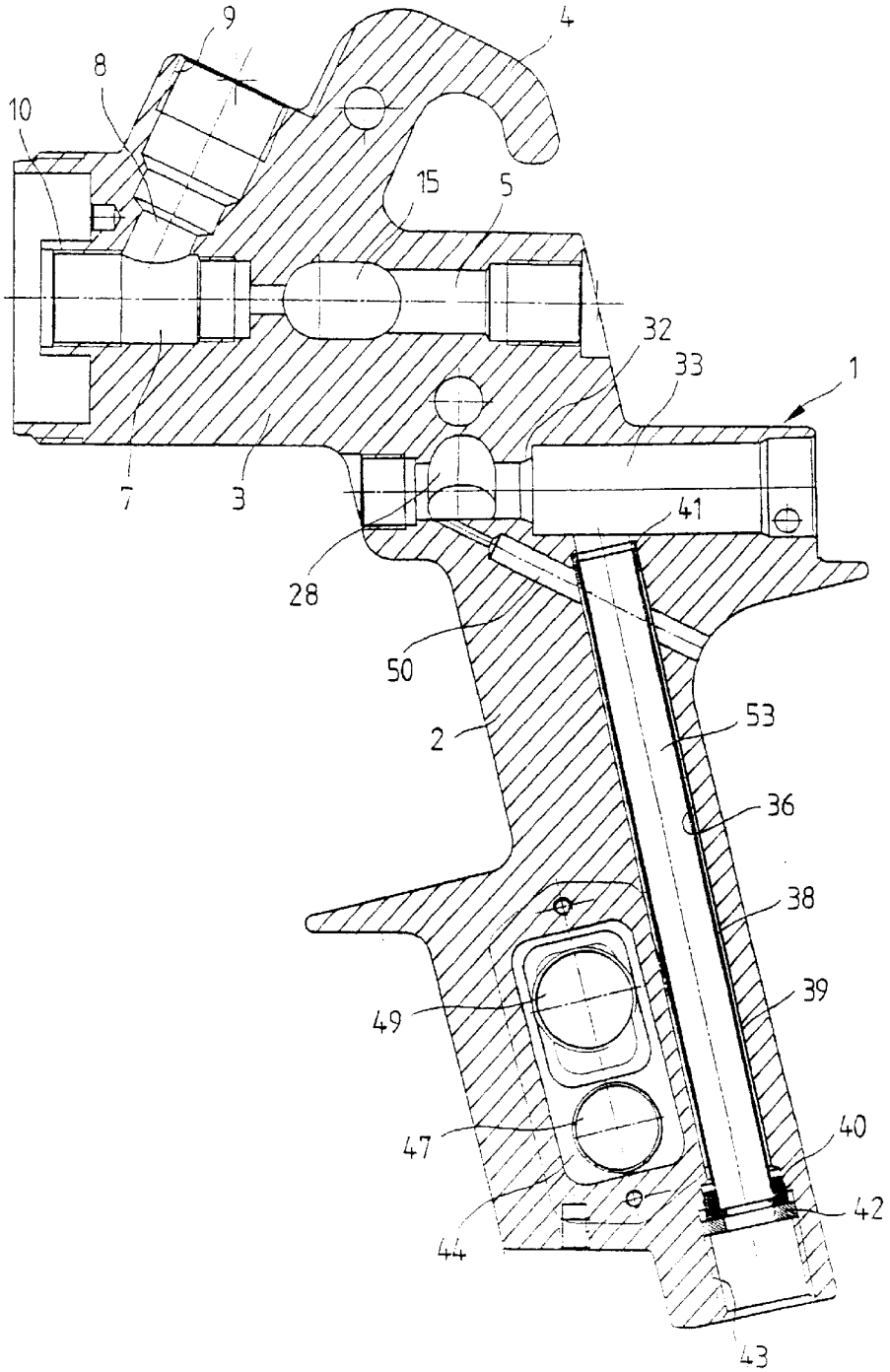
FIG. 2 is a gun body of a paint spray gun according to the invention.

As indicated particularly in FIG. 2, a tube 38 is inserted into the compressed air borehole 36 at a distance from its inner wall, the compressed air borehole running through the handgrip 2 towards the piston borehole 33, and the tube bordering an intermediate space 39, ring-shaped in cross-section, between its outer wall and the inner wall of the compressed air borehole 36. On each of the two ends of the tube 38 is a ring-shaped seal 40 and 41 respectively, through which the intermediate space 39 is sealed above and below with respect to the gun body 1. Furthermore, through both seals 40 and 41, the tube 38 is centrally held within the compressed air borehole 36. The tube 38 is secured in an axial direction through a retaining ring 42, which is screwed into an internal screw thread 43 provided at the inlet of the compressed air borehole 36.

A recess 44 for the accommodation of a device 45 shown in FIG. 1 for sensing and displaying the pressure predetermined through the valve system 29 is built into the handgrip 2 of the gun body 1. This pressure-sensing and pressure display device 45 includes a digital display 46 inserted into the recess 44 and a pressure sensor, for example, a piezoelectric pressure sensor, not shown in detail, which is placed in a pressure gauge chamber 47 in the handgrip 2. The digital display 46 and the pressure sensor are held by a cover plate 48, equipped with a window, in the handgrip 2, which is sealed using appropriate sealing elements to prevent the entry of liquid and dirt. Furthermore, in the handgrip 2, a holding compartment 49 accessible from its rear is provided for a battery for supplying electricity to the pressure-sensing and pressure display device 45.

The intermediate space 39, sealed above and below through the two seals 40 and 41, between the compressed air borehole 36 and the tube 38, is connected via a first connection channel to the pressure chamber 28 downstream of the valve face 32. This connection channel, in the design shown, consists of a first diagonal borehole 50, shifted to the side of the mid-axis of the compressed air borehole 36, and which runs from outside the handgrip 2 to the pressure chamber 28, and connected in a middle region with the intermediate space 39. The outer end of the borehole is sealed by a ball 51, shown in FIG. 1, or by another appropriate sealing element. A second connection channel, shown in FIG. 1, runs from the intermediate space 39 to the pressure gauge chamber 47. This connection channel 52 is expediently a second borehole 52, which runs from the inlet of the compressed air borehole 36 diagonally to the pressure gauge chamber 47. Through this arrangement, the second borehole 52 need not be sealed [by] a ball or the like, as in the case of the first connection channel. The first borehole 50 and the second borehole 52 are expediently designed as capillary boreholes with a diameter between 1 and 2 mm. This can prevent cleaning material and solvents respectively, used in cleaning the spray gun, and any dissolved lacquer particles, from reaching the pressure gauge chamber 47 and causing the impairment of the measuring accuracy there.

The compressed air is supplied to the valve system 29 through the tube 38, which forms a compressed air supply channel 53 in the interior. On the underside of the handgrip 2, a compressed air supply coupling 54 connected to the compressed air supply channel 53 is screwed into the compressed air borehole 36.

While various descriptions of the present invention are described above, it should be understood that the various features could be used singly or in any combination thereof. Therefore, this invention is not to be limited to only the specifically preferred embodiments depicted herein.

Further, it should be understood that variations and modifications within the spirit and scope of the invention might occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. Paint spray gun comprising:

a gun body having a handgrip;

a paint nozzle attached to the gun body;

an air nozzle placed around the paint nozzle;

a compressed air valve placed within a piston borehole in the gun body for controlling compressed air supply to the air nozzle;

a compressed air borehole having an inner wall and running through the handgrip of the gun body to the piston borehole;

a pressure-sensing and pressure display device placed in the handgrip; and a tube placed in the compressed air borehole at a distance from the inner wall, wherein the tube forms an interior channel for the compressed air supply to a part of the piston borehole upstream of the compressed air valve and wherein the tube borders an intermediate space between the tube exterior and the inner wall of the compressed air borehole, the intermediate space being connected via a first connection channel with a pressure chamber placed downstream of the compressed air valve and via a second connection channel with a pressure gauge chamber in the handgrip allocated to the pressure-sensing and pressure display device.

2. Paint spray gun according to claim 1 wherein the first connection channel is a first connecting borehole shifted to a side of the compressed air borehole mid-axis, the first connecting borehole running from outside of the handgrip to the pressure chamber and being connected in a middle region with the intermediate space.

3. Paint spray gun according to claim 2 wherein the first connecting borehole is sealed on an outer end by a ball.

4. Paint spray gun according to claim 2 wherein at least a portion of the first connecting borehole is a capillary borehole.

5. Paint spray gun according to claim 1 wherein the second connection channel is a second connecting borehole which extends from an inlet of the compressed air borehole diagonally through the handgrip to the pressure gauge chamber.

6. Paint spray gun according to claim 5 wherein at least a portion of the second connecting borehole is a capillary borehole.

7. Paint spray gun according to claim 1 wherein a ring-shaped seal is placed on each end of the tube through which the intermediate space is sealed above and below with respect to the gun body.

8. Paint spray gun according to claim 1 wherein the tube is secured through a retaining ring located at an inlet of the compressed air borehole.

9. Paint spray gun according to claim 1 wherein a compressed air supply coupling connected to the channel is placed on an inlet of the compressed air borehole.

* * * * *